US006496177B1

(12) United States Patent
Burton

(10) Patent No.: US 6,496,177 B1
(45) Date of Patent: Dec. 17, 2002

(54) LIQUID CRYSTAL DISPLAY (LCD) CONTRAST CONTROL SYSTEM AND METHOD

(75) Inventor: David L. Burton, McMinnville, OR (US)

(73) Assignee: Koninklijke Philips Electronics N.V., Eindhoven (NL)

( * ) Notice: Subject to any disclaimer, the term of this patent is extended or adjusted under 35 U.S.C. 154(b) by 0 days.

(21) Appl. No.: 09/512,100

(22) Filed: Feb. 24, 2000

(51) Int. Cl.[7] ..... G09G 3/36
(52) U.S. Cl. ..... 345/101; 345/87
(58) Field of Search ..... 340/87, 88, 89, 340/98, 99, 100, 101, 103; 349/72

(56) References Cited

U.S. PATENT DOCUMENTS 4,057,325 A * 11/1977 Kondo ..... 345/101
4,278,325 A * 7/1981 Kondo ..... 345/101
4,888,599 A * 12/1989 Harwood et al. ..... 345/101
5,029,982 A 7/1991 Nash ..... 350/331
5,033,822 A * 7/1991 Ooki et al. ..... 345/101
5,253,074 A 10/1993 Wortel et al. ..... 358/236
5,406,400 A 4/1995 Matsuda ..... 359/86
5,414,441 A * 5/1995 Memarzadeh et al. ..... 345/101
5,589,960 A 12/1996 Chiba et al. ..... 349/76
5,694,147 A 12/1997 Gaalema et al. ..... 345/101
5,767,934 A 6/1998 Goddard ..... 349/61
5,805,131 A 9/1998 Hartmann et al. ..... 345/101

* cited by examiner

*Primary Examiner*—Xiao Wu
(74) *Attorney, Agent, or Firm*—John Vodopia

(57) ABSTRACT

A liquid crystal display (LCD) device temperature compensation control system and associated methodologies that controls the contrast voltage provided to the LCD device based on the ambient temperature to enable the LCD to display data beyond the normal, manufacturer-specified operational temperature range. The LCD contrast ratio is dependent upon ambient temperature and contrast voltage. The invention controls the contrast voltage supplied to the LCD device such that it operates in either a standard or extended operating range based on ambient temperature to achieve an optimum contrast ratio. The invention may also adjust the frame rate and/or data inversion state of the displayed data.

17 Claims, 8 Drawing Sheets

FIG. 4

308

| AMBIENT TEMP. 101 | CONTRAST VOLTAGE 103 | | | |
|---|---|---|---|---|
| | NORMAL TEMP OPERATING CURVE 120 | | HIGH TEMP OPERATING CURVE 122 | |
| | TEMP-DEPENDENT COMPONENT 306A | OFFSET COMPONENT 320A | TEMP-DEPENDENT COMPONENT 306B | OFFSET COMPONENT 320B |
| -10 | 19.2 | | - | |
| 0 | 17.5 | | - | |
| 10 | 16.0 | | - | |
| 20 | 14.8 | | - | |
| 30 | 13.0 | | - | |
| 40 | 12.0 | | 18 | |
| 50 | - | | 17 | |
| 60 | - | | 16.2 | |
| 70 | - | | 15.9 | |

LIQUID CRYSTAL DISPLAY (LCD) CONTRAST CONTROL SYSTEM AND METHOD

BACKGROUND OF THE INVENTION

1. Field of The Invention

The present invention relates generally to liquid crystal displays (LCDs) and, more particularly, to controlling the contrast with which data is displayed on an LCD device.

2. Related Art

Sudden cardiac arrest has been attributed to over 350,000 deaths each year in the United States, making it one of the country's leading medical emergencies. Sudden cardiac arrest is a disruption of the natural heart's functioning, causing a lack of blood flow to vital organs. In a majority of instances, sudden cardiac arrest is manifested as an abnormal or chaotic heart rhythm, called fibrillation. These instances are generally identifiable by the victim's immediate loss of pulse, loss of consciousness and a cessation of breathing. Unless immediate medical intervention is initiated, sudden cardiac arrest can lead to death within a matter of minutes.

The critical components of medical treatment that must be administered to a victim of sudden cardiac arrest include (1) early access to emergency care; (2) early cardiopulmonary resuscitation to maintain blood oxygenation and flow to the victim's brain and other vital organs; (3) early defibrillation to restore the heart's regular rhythm; and (4) early access to advanced medical care. If cardiopulmonary arrest is followed by defibrillation within about four minutes, a victim's chance of survival can approach or exceed fifty percent. Prompt administration of defibrillation within the first critical minutes is considered one of the most important components of emergency medical treatment for preventing death from sudden cardiac arrest.

To achieve this, portable defibrillators have been developed that can be carried to a victim's location to defibrillate the victim prior to reaching a hospital. Initially, portable defibrillators were manually-controlled, sophisticated devices that could be used safely only by specially-trained medical personnel. More recently, however, defibrillators with advanced decision making functions, commonly known as automatic or semi-automatic external defibrillators (AEDs) have been developed. AEDs can be used safely by first responders with less advanced medical training.

There has been a trend to install these more advanced AEDs in public facilities such as shopping malls, hotels, commercial aircraft, stadiums, sports arenas, concert halls and the like, as well as to equip emergency response vehicles such as EMS vehicles, fire engines and police cars with such devices. These AEDs are subject to a wide range of environmental conditions. In particular, AEDs may be stored in a vehicle or facility for extended periods of time, subject to vibration, heat, etc. Beyond storage and transportation, these AEDs must also be capable of operating in a myriad of environmental conditions. For example, an AED may be required to operate in the dark, shade or direct sunlight; in precipitation as well as dry or humid conditions, etc.

Typical AEDs include a liquid crystal display (LCD) screen or panel, referred to generally herein as an LCD device. The LCD device may display a wide range of data to an operator during a resuscitation, including device status information, patient monitoring information, operator instructions and the like. The environmental conditions in which an AED must operate often effect adversely the ability of an operator to view clearly such information displayed on the LCD device. One environmental condition of particular relevance to the present application is ambient temperature.

Due to the above-noted storage, transportation and operating conditions, AEDs must be capable of performing reliably in a wide range of ambient temperatures that may be significantly greater than the temperature range that the LCD devices are designed to operate within, referred to herein as the normal or standard temperature range. For example, during a single use an AED may be transferred in a matter of minutes from a vehicle storage compartment wherein the ambient temperature exceeds 55° C. to an indoor facility wherein the ambient temperature is less than 20° C., at which immediate, reliable performance is required. In addition, use of the defibrillator in direct sunlight or in varying combinations of sunlight and shade may be required, all of which require data to be displayed with the appropriate contrast to enable the operator to view clearly the displayed data.

Unfortunately, many commonly available LCD devices exhibit poor or limited contrast characteristics when subject to high ambient temperatures, even those that are just slightly greater than the standard operating temperature. As a result, an operator of a defibrillator incorporating such an LCD device may be unable to visualize the displayed data when attempting to resuscitate a victim, or may have to relocate the victim to an environment in which the temperature is suitable for the LCD. Such delays only serve to decrease the likelihood of a successful resuscitation.

SUMMARY OF THE INVENTION

The present invention is directed to a liquid crystal display (LCD) device temperature compensation control system and associated methodologies. The invention controls the contrast voltage provided to the LCD device based on the ambient temperature of the LCD to enable the LCD to display data beyond the standard, manufacturer-specified operational temperature range or to improve the contrast when operating within the normal ambient temperature range.

Generally, the contrast ratio (luminance with all pixels white divided by luminance with all pixels black) of an LCD display depends primarily on ambient temperature. Generally, at a given ambient temperature an LCD device displays data with a range of contrast ratios in response to a range of corresponding contrast voltages provided to the LCD device. Beyond this standard contrast voltage/ambient temperature operational range the contrast ratio is approximately one; that is, all LCD device segments or regions (pixels) are either substantially white or substantially black. As noted, for certain implementing systems such as automatic and semi-automatic external defibrillators (AEDs), operating within this standard operating range may be insufficient to insure that the LCD device will display data with the requisite contrast in the anticipated operational environments.

The inventor has found that certain LCD devices can be controlled so that they contrast voltage/ambient temperature operational ranges. The first is the noted standard operating range. The second operational range in these LCD devices is separate and distinct from the standard operating range. The second operational range is effective for ambient temperatures that are greater than or equal to the high temperature region of the standard operating range. As such, this second operational range is referred to herein as the extended operating range. Thus, such an LCD device is controlled in accordance with two modes of operation: A standard operational mode and an extended operational mode. At normal ambient temperatures, the LCD device is controlled in accordance with the standard operational mode, the LCD device is controlled such that the relationship between the contrast voltage and ambient temperature is represented by the standard operating range. At ambient temperatures greater than or equal to those associated with the standard operating range, the LCD device is controlled in accordance with the extended operational mode. Here, application of a sufficient contrast voltage causes these certain LCD devices to improve the contrast of displayed data or to once again display previously non-visible data with a contrast ratio suitable to provide some visibility. Thus, the present invention takes advantage of the ability of the LCD device to operate in this second, extended operating range, controlling the contrast voltage supplied to the LCD device based on ambient temperature such that the LCD device operates within either the standard or extended operating range to achieve an optimum contrast ratio.

In connection with certain types of LCD devices, the present invention also adjusts the frame rate and/or data inversion state of the displayed data. With regard to frame rate, when subjected to higher ambient temperatures, the contrast of an LCD device improves with an increase in frame rate. Conversely, when subjected to lower ambient temperatures, the contrast of an LCD device degrades with an increase in frame rate. Aspects of the present invention select a frame rate based on the ambient temperature in which the device is being operated to further optimize the contrast of the displayed data. In one embodiment in which the above behavior is exhibited, the selected frame rate is controlled so as to correlate with changes in ambient temperature; that is, the frame rate is increased with an increase in ambient temperature, and is decreased with a decrease in ambient temperature.

With regard to data inversion state, LCDs commonly have two data inversion states: a normal display state in which black characters are presented on a white background, and an inverted display state in which white characters are displayed on a black background. The inventor has found that the liquid crystals in certain of the noted LCD devices behave unexpectedly when operating within the extended operating range. Specifically, the liquid crystals behave so as to invert the displayed data. To insure continuity of the display from the perspective of the operator, aspects of the present invention cause the inversion of the data provided to the LCD device under such conditions. This inverted data is then inverted again by the LCD device, resulting in a display of data having the same inversion state for the standard and extended operational modes.

A number of aspects of the invention are summarized below, along with different embodiments that may be implemented for each of the summarized aspects. It should be understood that the summarized embodiments are not necessarily inclusive or exclusive of each other and may be combined in any manner in connection with the same or different aspects that is non-conflicting and otherwise possible. These disclosed aspects of the invention, which are directed primarily to LCD contrast control systems and methodologies, are exemplary aspects only and are also to be considered non-limiting.

In one aspect of the invention, an apparatus for controlling a contrast voltage applied to an LCD device is disclosed. The contrast voltage is based on a current ambient temperature so as to cause data to be displayed on the LCD device with a contrast ratio that is associated with the applied contrast voltage and current ambient temperature. The applied contrast voltage is determined in accordance with a standard operating range and an extended operating range of ambient temperatures each of which having a corresponding range of contrast voltages. The applied contrast voltage is set in accordance with the standard operating range when the ambient temperature is below a first ambient temperature and is set in accordance with the extended operating range when the ambient temperature is greater than a second ambient temperature.

In accordance with another aspect of the present invention, an LCD device temperature compensation control system is disclosed. The system controls a contrast voltage provided to an LCD device based on ambient temperature of the LCD device to cause the LCD device to display data with a visible contrast ratio beyond the normal, manufacturer-specified operational temperature range, or to improve the contrast of displayed data at upper regions of the normal temperature range.

In a still further aspect of the invention, a liquid crystal display device temperature compensation control system is disclosed. This system controls contrast control parameters including a contrast voltage applied to an LCD device; a frame rate with which data is provided to the LCD device for display; and an inversion state of the displayed data. The contrast control parameters are adjusted such that the LCD device displays data with a particular contrast ratio.

In a still further aspect of the present invention, a defibrillator is disclosed. The defibrillator includes an LCD device that displays data with a contrast ratio that is dependent upon ambient temperature and a received contrast voltage. The LCD device displays data with a contrast ratio of less than one for a standard contrast voltage/ambient temperature operational range and an extended contrast voltage/ambient temperature operational range effective for ambient temperatures that are greater than or equal to temperatures defining the standard operational mode. The defibrillator also includes a device that controls the contrast voltage supplied to the LCD device such that it operates within either the standard or extended operating ranges based on ambient temperature to achieve an optimum contrast ratio.

In another aspect of the invention, a method for controlling the contrast voltage supplied to an LCD device is disclosed. The method includes the steps of (1) monitoring ambient temperature of the LCD device; and (2) supplying a contrast voltage to the LCD device. The contrast voltage is associated with a selected one of either a standard operating range of ambient temperatures or an extended operating range of ambient temperatures greater than the standard operating range of ambient temperatures. The contrast voltage is determined based on current ambient temperature and a selected operational mode.

Various embodiments of the present invention provide certain advantages and overcome certain drawbacks of the conventional LCD devices and traditional techniques for controlling the contrast with which data is displayed on such devices. Not all embodiments of the invention share the same advantages and those that do may not share them under all circumstances. This being said, the present invention provides numerous advantages including the noted advantage of controlling an LCD device so as to achieve an optimum contrast ratio for a given ambient temperature and, in particular, enabling the LCD device to display data with sufficient contrast at temperatures that are greater than standard operating temperatures. These and other features and advantages of the present invention as well as the structure and operation of various embodiments of the present invention are described in detail below with reference to the accompanying drawings.

BRIEF DESCRIPTION OF THE DRAWINGS

This invention is pointed out with particularity in the appended claims. The above and further advantages of this invention may be better understood by referring to the following description taken in conjunction with the accompanying drawings, in which:

FIG. 4 is a table illustrating the contents of a data structure utilized by the embodiment of the LCD contrast controller illustrated in FIG. 3.

DETAILED DESCRIPTION

The present invention is directed to a liquid crystal display (LCD) temperature compensation control apparatus and associated methodologies. The invention controls the contrast with which data is displayed on certain LCD devices based on ambient temperature such that data can be displayed with a sufficient contrast while the LCD is subject to ambient temperatures significantly greater than the standard, manufacturer-specified operational temperature range and/or display data with improved contrast when the ambient temperature is within the standard temperature range.

LCDs are commonly used display devices typically implemented in conjunction with processor-based systems. LCDs are primarily known for their low power consumption as compared with other display technologies such as CRT's. In contrast to conventional technologies, the LCD pixels or segment areas are defined by transparent electrodes separated from a common overlapping backplane by a single liquid crystal. An amorphous silicon implementing active matrix technology is described in M. Shur, "Physics of Semiconductor Devices," Englewood Cliffs, N.J., Prentice Hall, 1990, hereby incorporated by reference herein its entirety.

Materials classified as liquid crystals are typically liquid at high temperatures and solid at low temperatures. In an intermediate temperature range, however, the liquid crystals display characteristics of both. Application of an electric field to liquid crystals when exposed to this intermediate temperature range causes the liquid crystals to overcome their natural alignment with each other and with surrounding surface features to align with the electric field. It is through the application of such an electric field to addressable segments or regions of the LCD device that data is displayed on the LCD device. The electrical specifications established for operating a conventional LCD device include a supply voltage control input that is used by the LCD device to establish the electrical field. This supply voltage control input is referred to herein as a contrast voltage.

The contrast ratio of an LCD device is defined as the ratio of the luminance of the device with all pixels rendered white divided by the luminance of the device with all pixels rendered black. Generally, the contrast ratio of an LCD device depends primarily upon ambient temperature and contrast voltage. The operating range of the LCD device with regard to the relationship between contrast voltage and ambient temperature to achieve a desired contrast ratio is typically set forth in the above-noted electrical specifications. Typically, conventional systems set the contrast voltage to a value that achieves a desired contrast ratio when the LCD device is operated in the anticipated ambient temperature. The operator is generally able to thereafter make adjustments through the use of a contrast adjustment control.

Figure 1A:
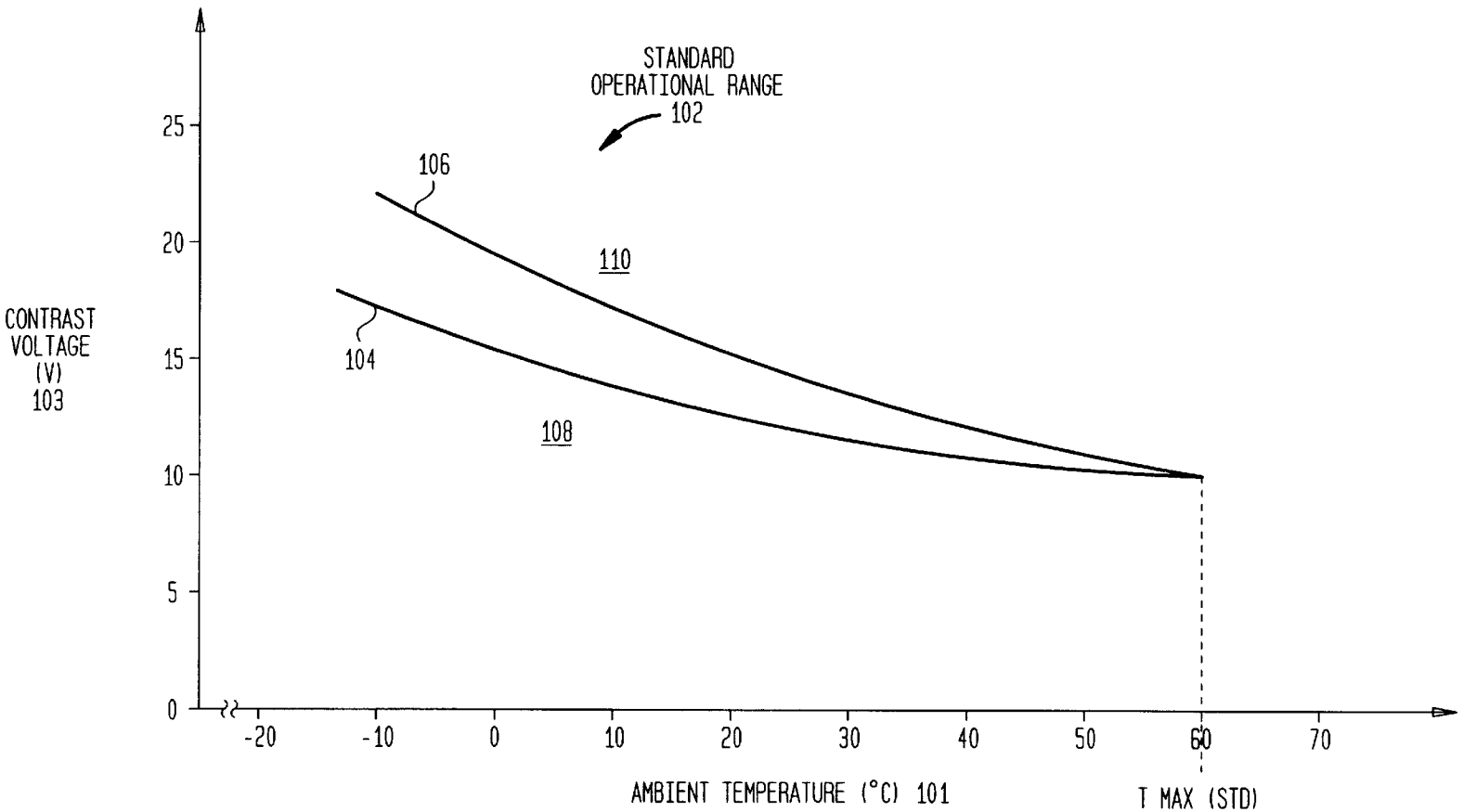
FIG. 1A is a graph of contrast voltage vs. ambient temperature for a conventional CD display device in standard operational mode.

A standard contrast voltage/ambient temperature operational range for an exemplary LCD device is set forth in FIG. 1A. Standard operating range 102 is bounded by a lower boundary curve 104 and an upper boundary curve 106. At a given ambient temperature 101 the LCD device displays data with a range of contrast ratios in response to application of a corresponding range of contrast voltages 103 as shown on FIG. 1A. Standard operating range 102 partitions the contrast voltage-ambient temperature landscape into different regions. When operating in region 108, the LCD device is essentially completely white; no data is visible and the contrast ratio is approximately one. Similarly, when operating in region 110, the contrast ratio is also approximately one, only here, the LCD is essentially completely black, with no data visible.

The upper and lower boundary curves 104, 106 represent a contrast ratio roughly corresponding to the limits of the contrast voltage range where visibility is achieved, with the maximum contrast for a given ambient temperature falling somewhere between the two boundary curves 104, 106. Thus, the contrast voltage/ambient temperature at which the contrast ratio reflects a display of data that is visible (with varying clarity) is located between boundary curves 104 and 106; that is, in standard operating range 102.

Take, for example, a range of contrast voltages 103 for a single ambient temperature 101. For a given ambient temperature 101 between the minimum and maximum standard temperatures, an increase of contrast voltage 103 from zero volts will cause the contrast ratio to proceed from a location in region 108 at which displayed data is not visible, to lower boundary curve 104 at which the contrast ratio has a magnitude sufficient to enable the displayed data to be visible. As contrast voltage 103 continues to increase, the magnitude of the contrast ratio decreases until a peak contrast is achieved at some location in standard operating range 102. As upper boundary curve 106 is approached the contrast ratio approaches approximately one, with the LCD device being primarily completely black at region 110.

The maximum temperature, $T_{max(std)}$, is approximately 60° C. for the exemplary LCD device. At ambient temperatures beyond this value, the LCD device will not display data with a contrast ratio suitable to be visible, regardless of the applied contrast voltage 103; that is, the contrast ratio resides in regions 108 or 110. Certain devices such as AEDs, can be subject to ambient temperatures that are beyond this maximum temperature. As a result, standard operating range 102 may be insufficient to insure that the LCD device will display data with the requisite clarity in the anticipated operational environments.

It should be understood that the contrast ratio of an LCD device does not change discretely. As such, upper and lower boundary curves 104, 106 are approximations only. It should also be understood that this range of contrast voltages 103 varies with individual LCD devices and types of devices. Thus, each LCD device has a specified standard contrast voltage/ambient temperature operational range 102.

It should also be appreciated that the operational behavior of each LCD device varies according to the technology, components and manufacturing process. The standard operating range 102 presented in FIG. 1A is for an active matrix LCD device, although other types of LCD devices may be controlled in accordance with the present invention. In particular, the exemplary LCD display presented herein in connection with this invention is the model number LM4Q30TA LCD display available from Sharp Microelectronics. The present invention may, however, be used in conjunction with other LCD active matrix devices as well as other display devices that can be controlled in accordance with two or more operational modes to extend temperature performance as described herein.

As noted, many commonly available LCD devices exhibit poor contrast ratios in high ambient temperature environments, making the devices difficult or impossible to implement. The inventor has found that when certain of these LCD devices, such as an active matrix LCD device in particular and the noted Sharp Microelectronics LCD device specifically, are subjected to ambient temperatures equal to and greater than those defining standard operating range 102, supplying certain greater contrast voltages will cause such LCD devices to once again display data with a contrast ratio sufficient to provide some visibility. In accordance with the present invention, the operating temperature range of such LCD devices is extended by increasing the LCD contrast voltage when the ambient temperature is greater than or equal to the maximum temperature of standard operating range 102.

Thus, in accordance with one aspect of the present invention, such LCD devices are controlled in accordance with two operational modes: a standard operational mode and an extended operational mode. At normal ambient temperatures, the LCD device is controlled in accordance with the standard operational mode. In this mode, the LCD device is controlled such that the relationship between the contrast voltage and ambient temperature is represented by the standard operating range. At ambient temperatures greater than the standard or normal ambient temperatures, the LCD device is controlled in accordance with the extended operational mode. Here, application of a predetermined contrast voltage causes certain LCD devices to once again display previously non-visible data with a contrast ratio suitable to provide some visibility. In addition, the extended operating range may include normal ambient temperatures. When operating an LCD device in accordance with the extended operational mode while it is subject to normal ambient temperatures, the applied contrast voltage is greater than the contrast voltage associated with the standard operating range. This improves the contrast of the displayed data in certain LCD devices. Thus, the present invention takes advantage of this second, extended operating range, controlling the contrast voltage supplied to the LCD device based on ambient temperature such that the LCD device operates within either the standard or extended operating range to achieve an optimum contrast ratio.

However, application of such increased contrast voltages does not simply cause the data to reappear as it did when a contrast voltage associated with the standard operating range 102 is supplied. Instead, application of a sufficient contrast voltage to cause a visible display will also cause an anomalous occurrence that may be preferably compensated for in a manner described below. Specifically, the liquid crystals in the LCD device respond to the increased applied potential by inverting the display state. That is, pixels that would normally be rendered black are rendered white and normally white pixels are rendered black. The approach taken by aspects of the present invention to compensate for this occurrence is described below.

Figure 1B:
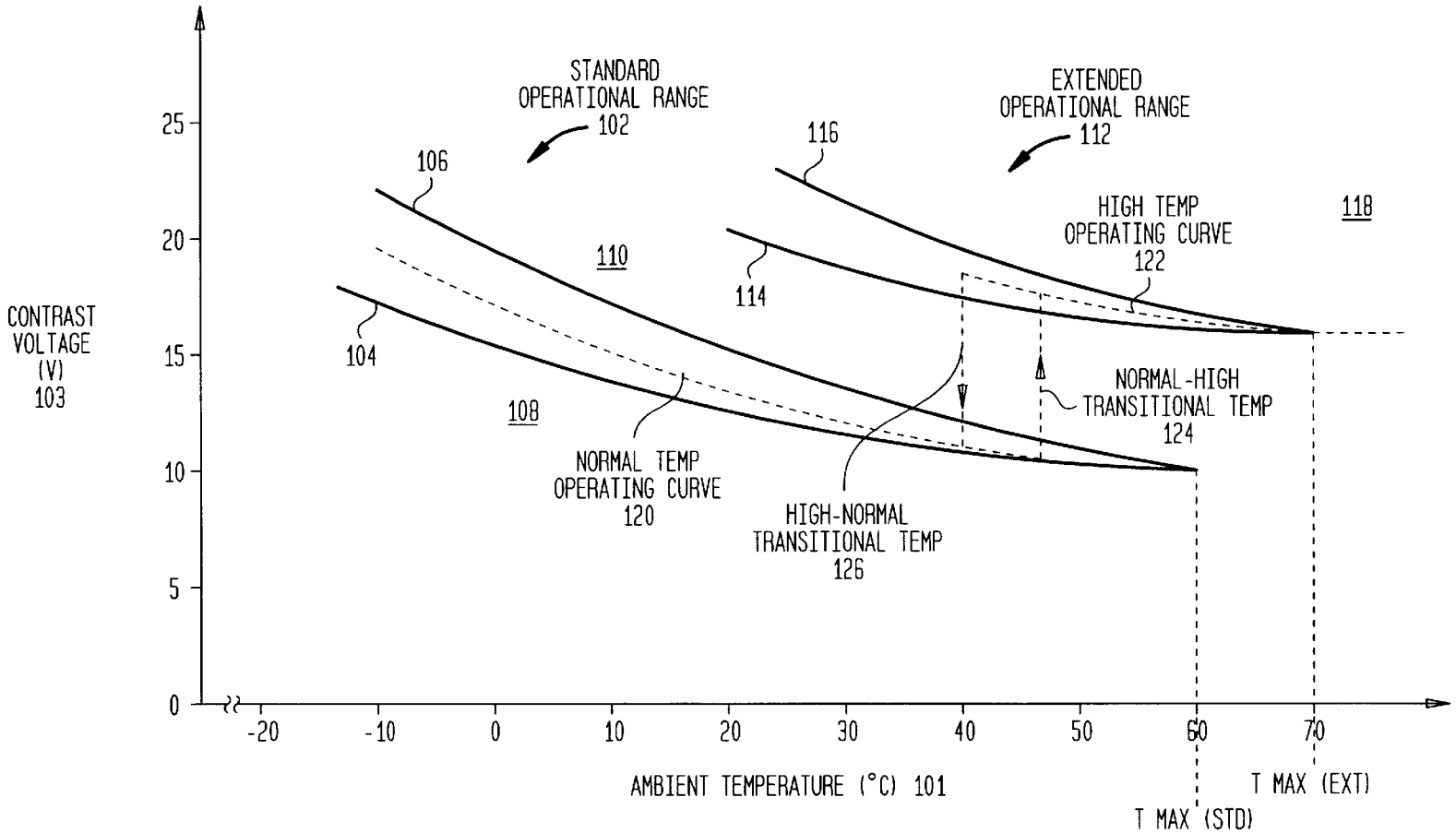
FIG. 1B is a graph of contrast voltage vs. ambient temperature for an exemplary CD display device in accordance with one embodiment of the present invention.

FIG. 1B is a graph illustrating two contrast voltage/ambient temperature operational ranges 102 and 112. Standard operating range 102 was introduced above with reference to FIG. 1A. Second operational range 112 is separate and distinct from standard operating range 102. This second operational range 112 is effective for ambient temperatures that preferably overlap those of standard operating temperature range 102, and at least extend beyond the high temperature limit $T_{max(std)}$ of standard operating range 102. Specifically, extended operating range 112 has a lower boundary curve 114 and an upper boundary curve 116. These boundary curves define the region of ambient temperature and contrast voltage at which the contrast ratio of the LCD device is a value that enables the displayed data to be at least somewhat visible.

As will be described in greater detail below, the present invention takes advantage of these dual operational modes, controlling the LCD device such that the contrast voltage 103 operates within a specific one of the two operational ranges 102, 112 to achieve an optimum contrast ratio for a given ambient temperature. The exemplary embodiment described herein controls contrast voltage 103 such that the contrast voltage/ambient temperature characteristics of the LCD device follows normal temperature operating curve 120 when ambient temperature 101 is within the temperature range associated with standard operating range 102, and follows high temperature operating curve 122 when ambient temperature 101 is equal to or greater than the temperature defining standard operating range 102. Thus, by controlling contrast voltage 103 to operate within extended operating range 112, the effective operating temperature range of the LCD device is increased from $T_{max(std)}$ of approximately 60° C. to $T_{max(ext)}$ of approximately 70° C., an increase of approximately 10° C.

The transition between normal temperature operating curve 120 to high temperature operating curve 122 may occur at the same or different temperatures. However, to avoid oscillations between the two curves it is preferred that the transition from curve 120 to curve 122 occurs at an ambient temperature that is greater than the temperature at which the contrast voltage transitions from curve 122 to curve 120. This induces hysteresis in the behavior of contrast voltage 103, preventing the oscillation that may occur if ambient temperature 101 is at the value of a single transition temperature.

In the example described above with respect to the Sharp Microelectronics LCD, high-to-normal transitional temperature 126 is approximately 40° C. while normal-to-high transitional temperature 124 is approximately 45° C.

However, the invention is not limited to these values, and one or more ambient temperatures may be used depending on the specific LCD employed, the particular operating characteristics of the LCD display and the range of temperatures in which it is possible to operate any given LCD in both modes of operation.

Furthermore, certain aspects of the present invention also control the manner in which data is provided to the LCD device such that it displays data with the optimum contrast in the given, optimized contrast ratio, thereby achieving an optimum display contrast for a wider range of ambient temperatures. Specifically, in connection with certain types of LCD display devices, aspects of the present invention also adjust the data inversion state of the displayed data and/or the frame rate at which the data is provided to the LCD device. With regard to the frame rate, a higher frame rate enables an LCD device to display data with a contrast that is superior to the contrast that would otherwise be achieved at a high ambient temperature. However, a higher frame rate also causes a degradation of the contrast with which data is displayed when the LCD device is subjected to lower ambient temperatures. The present invention instructs the implementing system to provide the LCD device with data at a frame rate that is suitable for the operational mode in which the LCD device is being controlled. In the exemplary embodiment, the frame rate is set to approximately 50 Hz when LCD contrast controller 202 is operating in accordance with the standard operational mode; that is, when the contrast voltage/ambient temperature follows normal temperature operating curve 120; and to approximately 70 Hz when operating in accordance with the extended operational mode; that is, when the contrast voltage/ambient temperature follows high temperature operating curve 122. In alternative embodiments, the frame rate is set for specific ambient temperatures rather than the operational mode. That is, the frame rate may vary continuously with ambient temperature 101. Other associations between ambient temperature and frame rate may be implemented as well. Generally, the frame rates are determined empirically within allowed limits for the specific display used.

With regard to the data inversion, there are commonly two data inversion states: a normal display state in which black characters are presented on a white background, and an inverted display state wherein white characters are displayed on a black background. As noted, the LCD devices that respond to increased contrast voltages at ambient temperature above the standard, manufacturer-specified ambient temperature, also often invert the displayed data when operating within extended operating range 112. To insure continuity of the display from the operator's perspective, aspects of the present invention cause the data that is provided to the LCD device to be inverted under such circumstances. The inverted data is then inverted once again by the LCD device, resulting in a display of data which is the same for the standard operational mode and extended operational mode. In the exemplary embodiment described herein, the LCD device inverts the data when the contrast voltage/ambient temperature follows high temperature operating curve 122. Accordingly, the present invention generates a command instructing the implementing system to invert the displayed data during the same operational period. It should be understood that the present invention may instruct the inversion of data during other circumstances depending upon the behavior of the LCD device that is being controlled.

Figure 2:
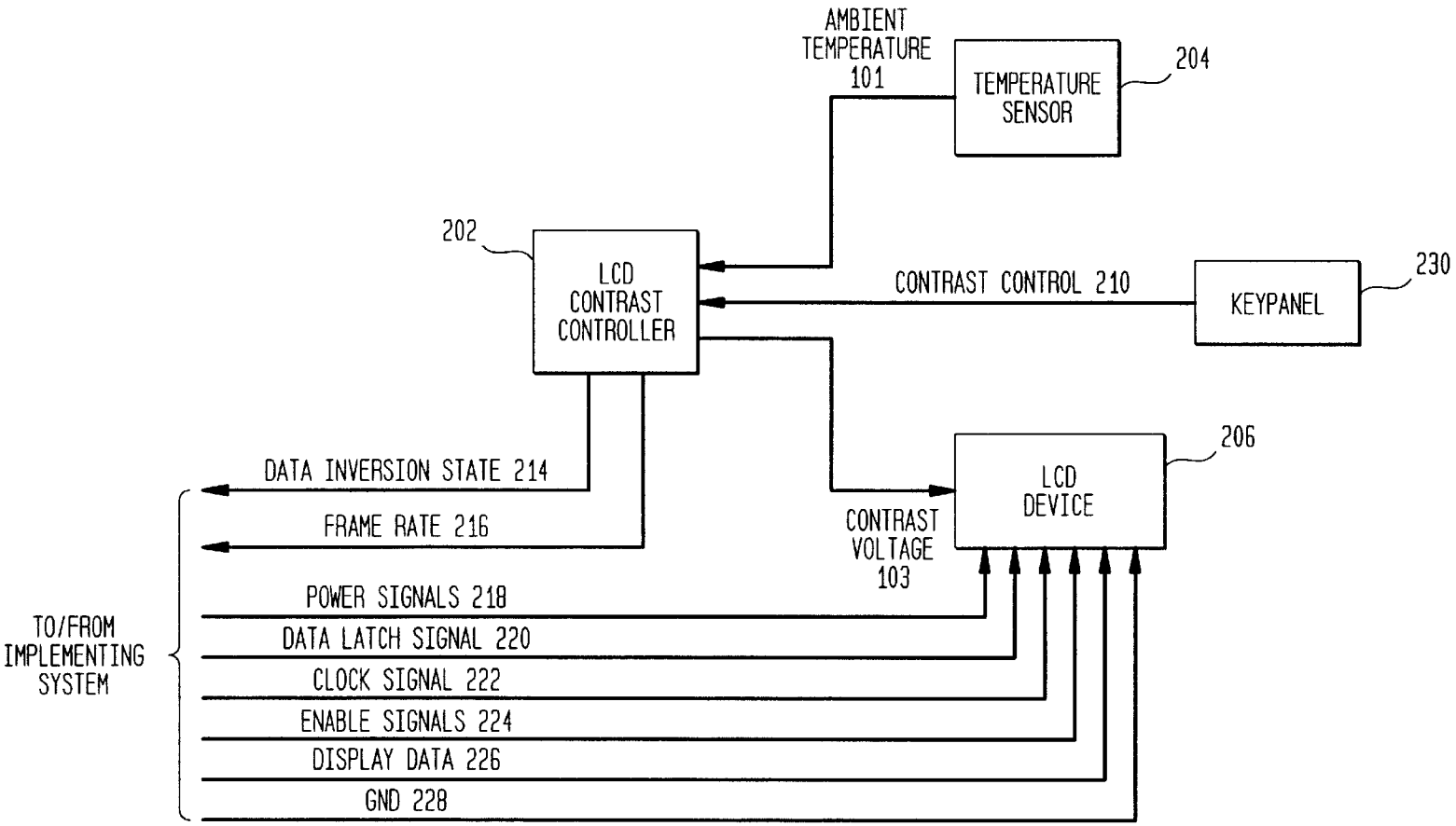
FIG. 2 is an interface block diagram of one embodiment of an LCD contrast controller of the present invention.

FIG. 2 is an interface block diagram of an LCD contrast controller constructed in accordance with one embodiment of the present invention. LCD contrast controller 202 receives an indication of ambient temperature 101 from a temperature sensor 204, and a contrast control signal 210 from, for example, key panel 230. LCD contrast controller 202 generates a contrast voltage 103 based on ambient temperature 101 and, preferably, contrast control 210 in a manner described below that enables the LCD device to display data with sufficient contrast over a greater range of ambient temperatures than otherwise achievable in conventional systems.

LCD contrast controller 202 generates contrast voltage 103 that is received by LCD device 206. Contrast voltage 103 determines the contrast ratio with which LCD device 206 displays data. As noted, in certain embodiments, LCD contrast controller 202 also controls the frame rate and data inversion state of the displayed data to improve the contrast with which the displayed data is presented. In such embodiments, LCD contrast controller 202 also generates a data inversion state signal 214 and/or a frame rate signal 216. As shown in FIG. 2, these two control signals are received by the implementing system which adjusts the respective data inversion state and/or the frame rate accordingly.

As noted, the specification for an LCD device such as LCD device 206 includes the identification of a number of signals required to operate the device. These signals, provided by the implementing system in FIG. 2, include power signals 218, data latch signal 220, clock signal 222, enable signals 224, display data signals 226 and ground 228. These signals, although referred to periodically herein, are not part of the invention and are considered to be well known in the relevant art. Accordingly, further description of such signals is not provided herein.

Figure 3:
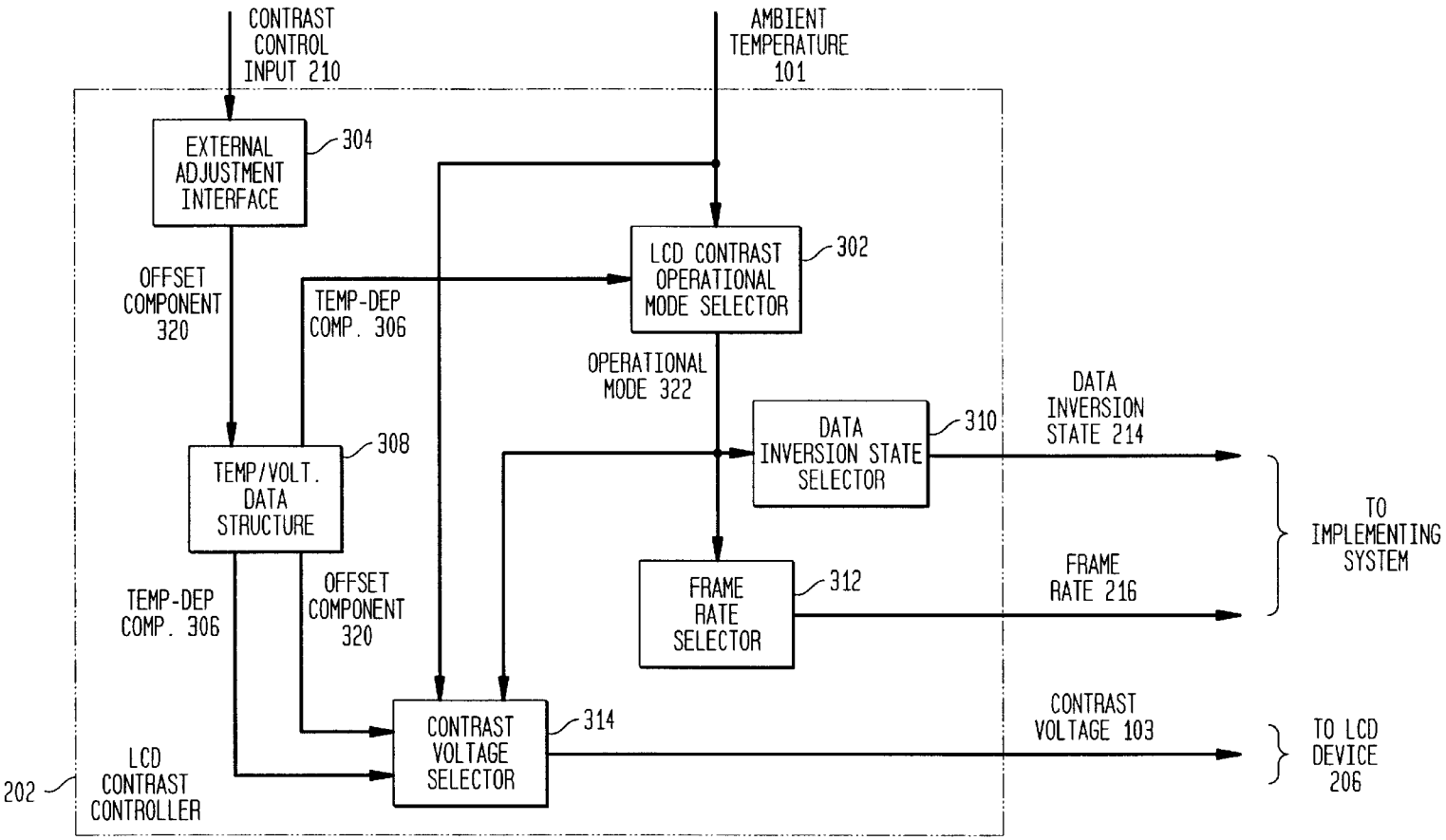
FIG. 3 is a functional block diagram of one embodiment of the LCD contrast controller introduced in FIG. 2.

FIG. 3 is a functional block diagram of one embodiment of LCD contrast controller 202. In this aspect of the invention, LCD contrast controller 202 includes an LCD contrast operational mode selector 302 that determine whether contrast voltage 103 is to be controlled in accordance with the standard operational mode such as, for example, along normal temperature operating curve 120; or extended operational mode such as, for example, along high temperature operating curve 122. As will be described in detail below, LCD contrast controller 202 maintains, calculates or otherwise determines this relationship between ambient temperature 101 and contrast voltage 103. In the embodiment described below, this relationship is maintained in a data structure of values implemented, for example, as a look-up table.

FIG. 4 is a table illustrating the contents of such a data structure. The contents of data structure 308 will now be described with respect to normal temperature operating curve 120 representing the relationship between contrast voltage 103 and ambient temperature 101 when ambient temperature 101 is in standard operating range 102, and high temperature operating curve 122 representing the relationship between contrast voltage 103 and ambient temperature 101 when ambient temperature 101 is in extended operating range 112. The contrast voltage values for both curves are set out separately in the table illustrated in FIG. 4. It should be noted that just a few representative values are illustrated. In a practical implementation, contrast voltages associated with ambient temperature 101 may be stored in increments of arbitrary precision or interpolated in a piece-wise continuous fashion from a limited number of discrete values in the table.

In the disclosed aspect of the invention, contrast voltage 103 is comprised of two components: a temperature-dependent component 306 and an offset component 320. Temperature-dependant component 306 is that portion of contrast voltage 103 that is determined based on ambient temperature 101 in accordance with the present invention. Offset component 320 is the adjustment value attributable to contrast control input 210 described below. The sum of these two components is equivalent to contrast voltage 103 that is provided to LCD device 206, as noted above with reference to FIG. 2. Each of these contrast voltage components are described below.

Embodiments of LCD contrast controller 202 include an external adjustment interface 304. External adjustment interface 304 generates offset component 320 that is used to adjust all or part of either or both, standard operating range 102 and extended operating range 112 in response to a contrast control input signal 210. Specifically, external adjustment interface 304 generates a contrast offset component 320 that serves as an offset value when determining contrast voltage 103.

In one embodiment, contrast control signal 210 is generated in response to the operator adjusting a control mechanism such as physical knob or dial on the implementing system or LCD panel, for example, contrast control buttons or knob(s). Such a control mechanism may also be a software control feature accessed by the operator through a user interface such as key panel 230. It should be understood, however, that contrast control 210 may be generated by any technique now or later developed.

The ability of the operator to adjust, through contrast voltage 103, the contrast ratio of LCD device 206, enables the operator to improve visibility of the particular LCD device 206 for the particular operator and operating environment. In addition, contrast control signal 210 may be generated automatically based on, for example, detected direct sunlight, ambient light, etc.

External adjustment interface 304 generates offset component 320 based on contrast control signal 210 which is then stored in temperature/voltage data structure 308 in association with one or more ambient temperatures 101 of either or both, normal temperature operating curve 120 and high temperature operating curve 122. That is, offset component 320 is stored as an offset component 320A or 320B of contrast voltage 103 for one or more temperatures for either normal temperature operating curve 120 or high temperature operating curve 122.

In one embodiment, offset component 320 is applied to all temperature-dependent components 306A, 306B in curves 120, 122. In another embodiment, offset component 320 is applied to only the operating curve 120, 122 that is currently being implemented by LCD contrast controller 202 at the time the contrast adjustment is made. In other words, if LCD device 206 is being controlled in accordance with the standard operational mode when a contrast control input 210 is received, the resulting offset component 320 is applied to normal temperature operating curve 120 and is stored as offset component 320A in data structure 308. The offset component 320B associated with high temperature operating curve 122 would not be altered in such an example.

In a still further embodiment, contrast voltage offset component 320 is applied to a specified temperature or temperature range of the currently implemented operating curve 120, 122. This enables the operator to alter the shape of the applied curve 120, 122, thereby more specifically defining the relationship between contrast voltage 212 and ambient temperature 101.

Referring again to FIG. 3, operational mode selector 302 determines whether contrast voltage 103 will be set in accordance with the standard or extended operational mode. It should be appreciated that in embodiments wherein hysteresis is implemented to prevent unnecessary oscillations between the two operational modes, historical ambient temperature and contrast voltage information may be used to make this determination. For example, referring again to FIG. 1B, an ambient temperature of 42° C. will cause LCD contrast controller 202 to operate within the extended operating range 112 if the immediately prior ambient temperature caused LCD contrast controller 202 to remain in or transition to the extended operational mode. Alternatively, at the same ambient temperature of 42° C., LCD contrast controller 202 may operate within standard operating range 102 if the immediate prior ambient temperature caused LCD contrast controller 202 to transition to or remain in the standard operational mode.

As shown in FIG. 3, operational mode selector 302 receives temperature-dependent component 306 of contrast voltage 103 to make this determination. Alternatively, mode selector 302 may utilize contrast voltage 103 to make such a determination. LCD contrast mode selector 302 provides the selected contrast operational mode 322 to contrast voltage selector 314 and, in certain aspects of the invention, to a frame rate selector 312 and a data inversion state selector 310.

Contrast voltage selector 314 generates contrast voltage 103 based on the selected operational mode 322 and ambient temperature 101. Specifically, contrast voltage selector 314 receives contrast operational mode 322 from selector 302 and ambient temperature 101 from temperature sensor 204. Contrast voltage selector 314 accesses data structure 308 and retrieves temperature-dependent component 306 and offset component 316 associated with the current ambient temperature 101 and contrast mode 322. Selector 314 then sums the two retrieved values to determine contrast voltage 103. This contrast voltage is then provided to LCD device 206 as shown in FIG. 3.

As noted, in certain embodiments of the present invention, LCD contrast controller 202 also determines the frame rate at which the data is provided to LCD device 206. This was illustrated in FIG. 2 by a frame rate command 216 being provided to the implementing system. In the illustrative implementation illustrated in FIG. 3, a frame rate selector 312 is included in LCD contrast controller 202. Frame rate selector 312 receives operational mode 322 from selector 302 and generates frame rate command 216. In this embodiment, the frame rate 216 is based on whether contrast voltage 103 is to be set in accordance with the standard or extended operational modes. In the exemplary embodiment, frame rate 216 is set to approximately 50 Hz when LCD contrast controller 202 is controlling the LCD in accordance with the standard operational mode, and to approximately 70 Hz when controlling the LCD in accordance with the extended operational mode. In the exemplary LCD device 202 described above, contrast controller 202 sets the frame rate at 50 Hz when the contrast voltage/ambient temperature follow normal temperature operating curve 120, and at approximately 70 Hz when the contrast voltage/ambient temperature follows high temperature operating curve 122. The frame rates may be that specified by the LCD device manufacturer, determined empirically, etc. It should be appreciated, however, that the frame rate may be determined on a more temperature specific manner. For example, the frame rate may vary continuously with ambient temperature 101. In such implementations, the frame rate 216 may be added to data structure 308 and retrieved by frame rate selector 312.

As noted, in certain embodiments of the present invention, LCD contrast controller 202 also determines the inversion state of the displayed data. In the embodiment illustrated in FIG. 3, LCD contrast controller 202 includes a data inversion state selector 310 that receives operational mode selection 322 from selector 302 and generates a data inversion state 214. As with frame rate command 216, the data inversion state command 214 is provided to the implementing system. The inversion state command is set in accordance with the implemented LCD device, as noted above.

Figure 5:
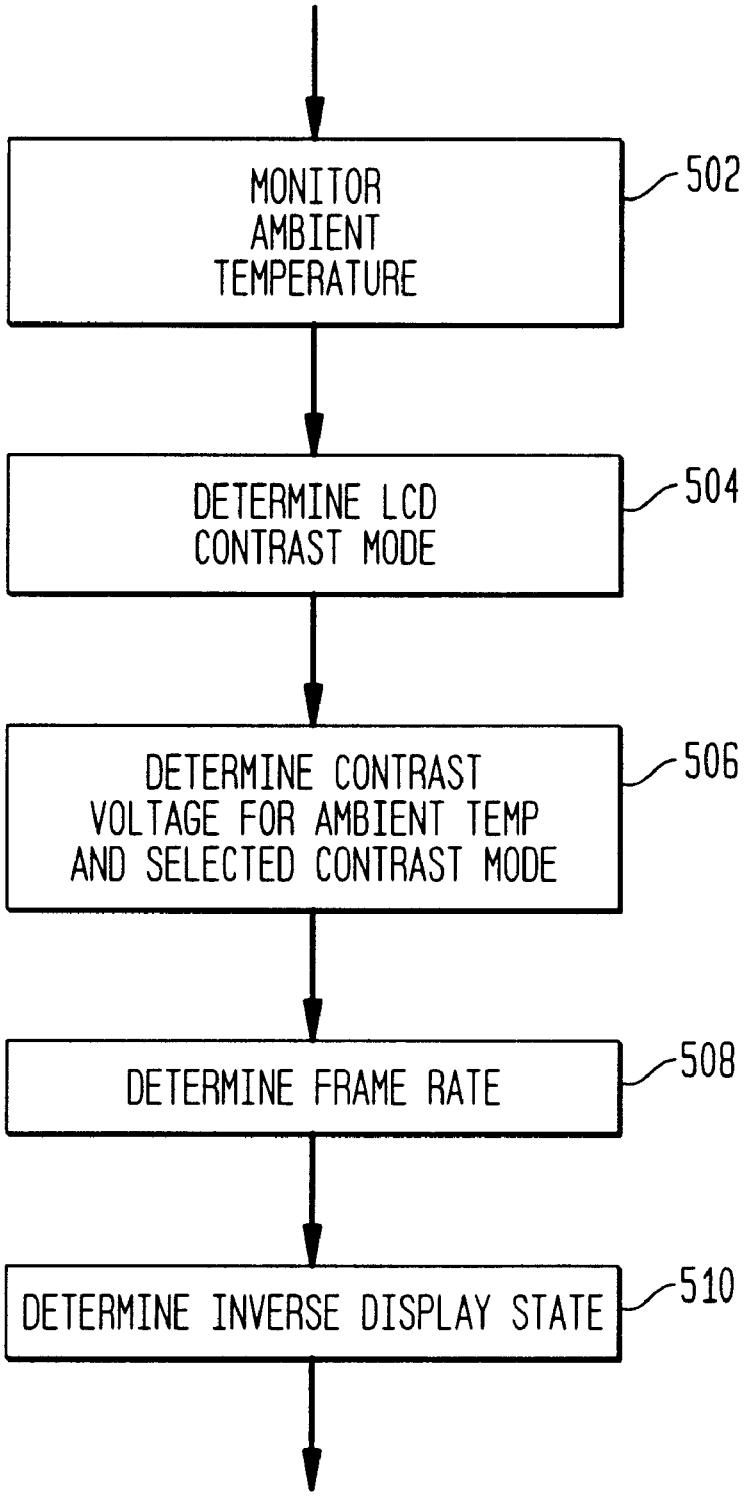
FIG. 5 is a high level flow chart of the operations performed by the LCD contrast controller in accordance with one embodiment of the present invention.

FIG. 5 is a high level flow chart of the processes performed by LCD contrast controller 202 in accordance with one embodiment of the present invention. In this embodiment, LCD contrast controller 202 controls contrast voltage 103, data inversion states 214 and frame rate 216 to effect a desired display of data at an optimum contrast ratio.

At block 502, LCD contrast controller 202 monitors ambient temperature 101 of LCD device 206. Based on the detected ambient temperature, the LCD contrast operational mode is determined at block 504. This operational mode, as noted, determines whether contrast voltage 103 is going to be controlled such that the contrast voltage/ambient temperature relationship is defined by standard operating range 102 or the extended operating range 112.

Based on the ambient temperature detected at block 502 and the LCD contrast mode determined at block 504, contrast voltage 103 is determined at block 506. As noted, contrast voltage 103 follows normal temperature operating curve 120 and high temperature operating curve 122, transitioning between these two curves in accordance with transition temperatures 124 and 126. This relationship between contrast voltage 103 and ambient temperature 101 may be maintained in a data structure, calculated, or otherwise determined by LCD contrast controller 202.

The frame rate at which the data is provided to LCD display device 206 is determined at block 508. The frame rate may be determined based the current ambient temperature, whether the current ambient temperature resides within a certain range of temperatures, etc. As noted, in certain embodiments of the present invention, the frame rate is adjusted in accordance with the selected contrast operational mode. This is to simplify the control algorithm. Thus, to take advantage of such characteristics of these LCD devices, embodiments of the present invention adjust the frame rate in accordance with the contrast operational mode in which the contrast voltage is being driven in accordance with. Once the frame rate is determined, it is provided to the implementing system.

Similarly, at block 510, the data inversion state is determined. The display data is inverted at block 510 to nullify the above-noted anomalous behavior of certain LCD devices when subjected to certain combinations of contrast voltage and ambient temperature.

Figure 6:
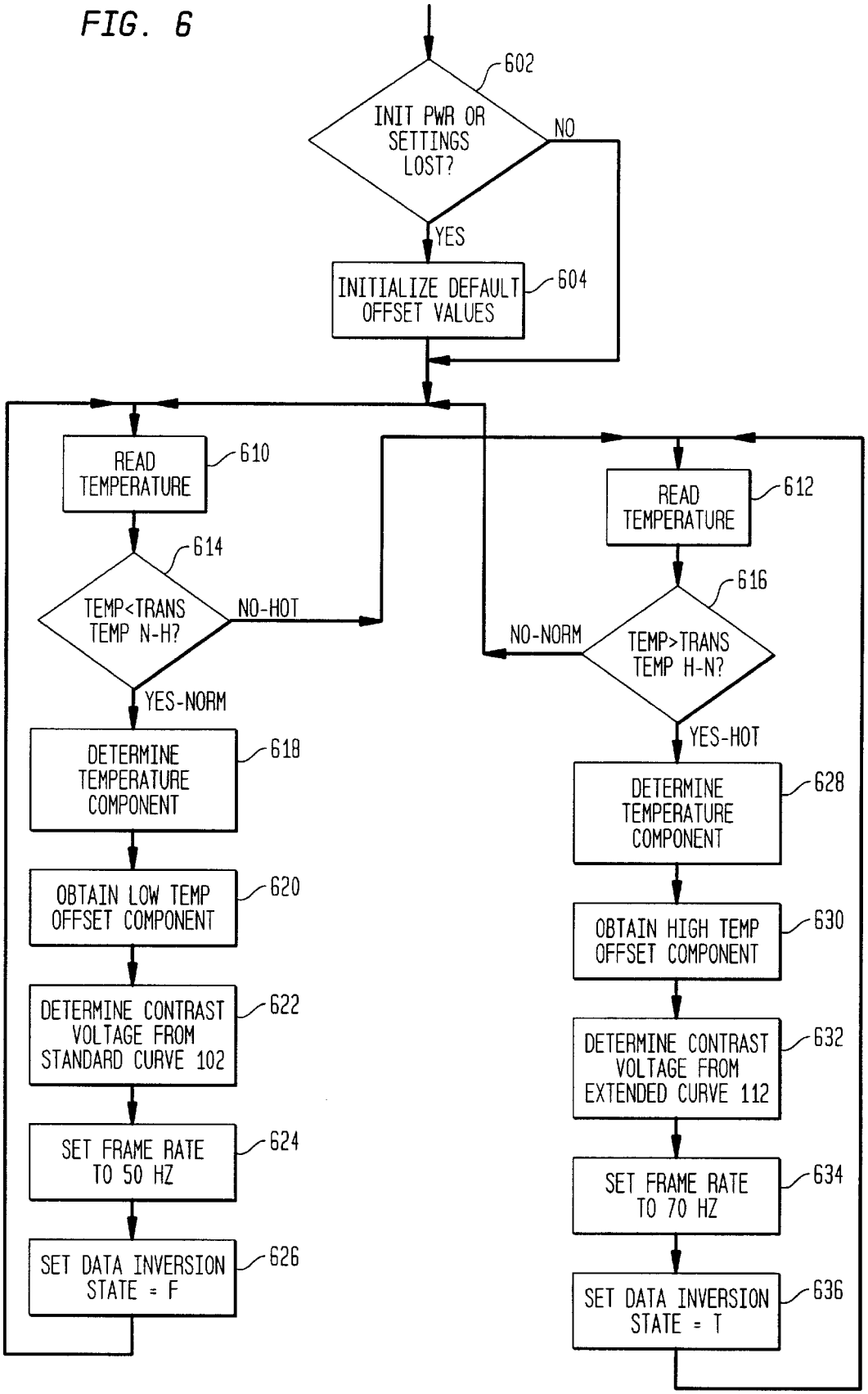
FIG. 6 is a detailed level flow chart of the operations performed by the LCD contrast controller in accordance with one embodiment of the present invention.

FIG. 6 is a detailed flow chart of one embodiment of the LCD contrast control operations of the present invention wherein two operational modes are implemented. At block 602 it is determined whether the implementing device has been powered initially or otherwise requires the initialization of the contrast voltage offset values. Preferably the values are stored in non-volatile memory so that the operator's settings are always preserved. These can be, for example, previously stored values. If so, processing continues at block 604, discussed below, at which such initialization processes are performed. Otherwise, the power-on condition is considered to a normal power on condition.

Upon initial power on or if the initial set-up is lost, it is necessary to initialize the offset values of contrast voltage 103 for the implemented LCD device 208. These initialized values may be predetermined or input by the operator. Optionally, the operator may be provided with an opportunity to adjust the offset values.

The contrast operational mode is initially selected. Alternatively, the mode may be determined initially based on the current ambient temperature 101. For example, the current ambient temperature 101 may be compared with an arbitrary threshold temperature to determine which operational mode should be initially selected. If ambient temperature 101 is greater than this threshold temperature, then LCD device 206 is considered to be warm or hot and the extended operational mode is implemented. Alternatively, if ambient temperature 101 is below this threshold value, and LCD display 206 is considered to be not hot. In this circumstance, standard operational mode is implemented.

It should be understood that in such embodiments any threshold temperature value may be used, or that this portion of the process can be eliminated. It should also be understood that such a threshold value is an arbitrary value selected such that the initially selected operational mode is the range in which LCD device 206 operates for some future time. In the embodiment described herein in which there are two transitions between two operational modes, the threshold temperature value is preferably a value between these two transition temperatures. For example, in the exemplary embodiment noted above, the two temperature transitions are at 40° C. and 45° C. In this example, the threshold temperature value is 42.5 degrees. Other values or technique may be used. Thus, when ambient temperature 101 is below the initial temperature threshold, then processing proceeds to blocks 618–626; otherwise, processing proceeds to blocks 628–636.

Processing continues at block 610 which is the first of a series of processes which are performed in relation to normal ambient temperature. The first operation to be performed is at block 610 where at the ambient temperature 101 is determined. A similar process is performed at block 612 when it is determined that ambient temperature 101 is sufficiently high that LCD device 206 is considered to be operating outside of standard operating range 102.

After ascertaining the current ambient temperature 101, LCD contrast controller 202 determines whether current ambient temperatures 101 has traveled above normal-to-high transitional temperature 124 at block 614. As noted, transitional temperature 124 is that temperature at which contrast controller 202 changes between controlling contrast voltage 103 from normal temperature operating curve 120 to high temperature operating curve 122. If ambient temperature 101 is determined to be less than transitional temperature 124, LCD device 206 is controlled in accordance with the standard operational mode, embodied in blocks 618–626, as described below.

Similarly, at decision block 616, it is determined whether ambient temperature 101 has traveled below high-to-normal transition temperature 126. As noted, transitional temperature 126 is that temperature at which LCD contrast controller 202 changes between controlling contrast voltage 103 from high temperature operating curve 122 to normal temperature operating curve 120. If such a condition did not occur, then LCD device 206 is controlled in accordance with the extended operational mode, embodied in block 628–636, as described below. Otherwise, control passes to blocks 610, 614 and, possibly, 618–626 to perform normal temperature operations as described herein.

As illustrated in FIG. 6, the processes performed at blocks 618–626 are analogous to the processes performed at blocks 628–636, respectively. Accordingly, analogous blocks will be described together in the following description to facilitate ease of description.

The temperature-dependent component of contrast voltage 101 is obtained for the current ambient temperature 101 in accordance with standard and extended operational modes at block 618 and 628, respectively. These values are preloaded in a look-up table or are calculated using any well known programming language and technique.

The current offset value 320A, 320B is determined at blocks 620 and 630. The offset values are stored in some well known manner such as in a table or database. In one embodiment, they are stored in the same table as the temperature-dependent component of the contrast voltage, as described above. As noted, the offset values are preferably factory default adjustment values modified by user adjustments and are not based on temperature.

Contrast controller 202 adds the temperature offset value to the temperature-dependent component 306 to arrive at contrast voltage 103 that is then provided to LCD device 206. Adding the offset voltage after determining the temperature dependent component of the supply voltage enables the operator to adjust the relative contrast by simply adjusting the offset values at any time during the use of the implementing system. Optionally, this operation could be eliminated by updating the table of temperature dependent voltage supply values by adding the offset value to each value in the table. Likewise, in an embodiment using an equation to determine the temperature dependent component of the voltage supply value, the equation defining the relationship between these two variables could be modified to take into account the value of the offset.

There are a myriad of techniques that can be implemented to achieve the control voltage 103 based on the temperature-dependent component and the offset values. For example, the sum of the two values for each ambient temperature may be recalculated each time one of the two values is altered. The sum, which would be maintained in table 308, would then be applied to LCD display device 206. Alternatively, a single control voltage 103 may be maintained in memory which is adjusted each time the offset value is altered.

The frame rate at which the data is provided to LCD display device 206 is determined at blocks 624, 634 and the data inversion state is determined at block 626, 636, as described above.

Figure 7:
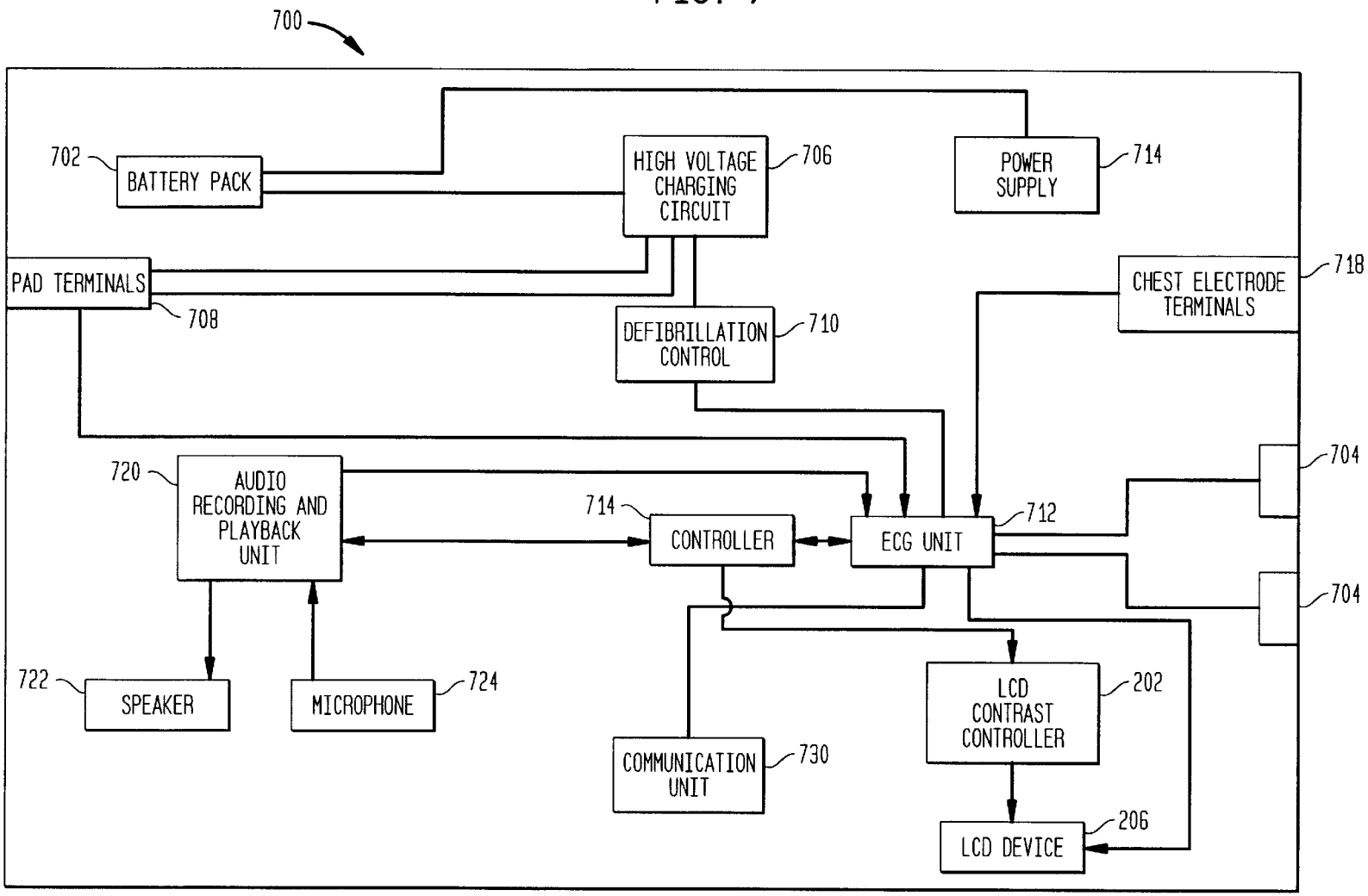
FIG. 7 is a functional block diagram of a defibrillator incorporating an LCD display device and an LCD contrast controller in accordance with one embodiment of the present invention.

FIG. 7 is a block diagram of one embodiment of a defibrillator implementing the LCD contrast controller of the present invention. In this embodiment an automatic external defibrillator 700 includes a battery pack 702, preferably having one or more batteries capable of providing power to defibrillator 700 for several hours of operation. As a battery-powered device, defibrillator 700 is highly portable and therefore suitable for pre-hospital (emergency) use. From the following description of defibrillator 700, those skilled in the art will appreciate that defibrillator 700 may be implemented utilizing conventional microprocessor and support circuitry, or alternatively, one or more application-specific integrated circuits. Operator controls 704 enable the operator to control defibrillator 700 and many of the defibrillator's functions. Interaction between the operator and defibrillator 700 via operator controls 704 is specified by the particular defibrillator interface design.

On demand, battery pack 702 supplies charge to a capacitor or other storage device utilized to store the large charge required to defibrillate a patient suffering from sudden cardiac arrest contained within a high voltage charging circuit 706. High voltage charging circuit 706 is electrically connected to a pair of pads (not shown) utilized to deliver a defibrillating shock to the patient via pad terminals 708. The delivery of the defibrillating shock is controlled by defibrillation control 710 in communication with ECG unit 712 (described below). Battery pack 702 is further electrically coupled to power supply 714 that supplies power to the control and monitoring circuitry of the defibrillator 700.

Defibrillator 700 further includes electrocardiogram (ECG) unit 712, having a controller 714, which controls the monitoring and display functions of defibrillator 700 and communicates with defibrillation control 710 to coordinate delivery of the defibrillating shock. ECG unit 712 receives ECG data from the patient through the pads or via chest electrodes (not shown) connected to defibrillator 700 at pad or chest electrode terminals 708, 718, respectively. The ECG data received from the patient may be displayed to the operator of defibrillator 700 on LCD display device 206 according to any known format, such as in the form of a conventional ECG waveform trace, and may be displayed in conjunction with additional information extracted from the ECG data, such as the patient's instantaneous pulse rate, etc.

Defibrillator 700 may be provided with a number of optional features, such as a thermal printer (not shown) to enable defibrillator 700 to print out a treatment summary after defibrillation is complete; an audio recording and playback unit 720 equipped with a speaker 722 and microphone 724 to provide audible instructions and record audio information associated with the resuscitation attempt; and a communication unit 730 connected, for example, to a cellular or land-based telephone network, to enable one or two way communication between the defibrillator 700 and a central station. In addition, defibrillator 700 may be provided with an infrared serial port or other data communication means such as a PCMCIA memory slot (not illustrated) to enable the contents of the defibrillator memory 716 to be directly downloaded to a computer for review and analysis. Inclusion or exclusion of these optional features does not affect the invention and will not be discussed in greater detail herein.

While one particular example of an LCD display for use with this invention has been provided, the invention is not limited to use with this one particular LCD display, and any other LCD display exhibiting these characteristics is likewise encompassed by this invention. For example, in the disclosed embodiment of the present invention, the contrast ratio of the LCD device is controlled based on ambient temperature. In alternative embodiments additional or alternative environmental conditions that effect the contrast ratio may be considered. For example, other conditions such as barometric pressure, humidity, ambient and direct light, etc. may be considered.

It should also be appreciated that the ambient temperature may be measured directly as disclosed above or indirectly through other measurable attributes. Also, in the disclosed embodiments, a data structure has been described implementing the operating curves illustrated in FIG. 1A. However, it should be understood that other techniques for implementing the operational curves may be used. For example, a microprocessor may be programmed with equations or algorithms to relate ambient temperature to the LCD contrast voltage. It should also be understood that the data structure may be implemented using any programming and data storage techniques now or later developed.

With regard to temperature sensors, the invention is not limited to using a temperature sensor or to using any one particular temperature sensor. Examples of temperature sensors usable to provide a signal indicative of the temperature of the LCD include thermocouples, digital temperature sensors, and other commonly available temperature sensors. Temperature sensor 204 may be external to LCD display 206 or may be provided integral with the LCD display 206.

It should be understood that the components of LCD contrast controller 202 may be implemented in any well known manner including software, hardware, firmware or a combination thereof. For example, certain operations of the present invention may be implemented in a software program that is executed on a commercially available microprocessor while other operations are performed in an ASIC. Such a microprocessor may be a dedicated microprocessor assigned to controlling LCD display contrast or may be a general purpose processor assigned to perform a myriad of tasks including LCD contrast control of the present invention.

It should be understood that various changes and modifications of the embodiments shown in the drawings and described in the specification may be made within the spirit and scope of the present invention. Accordingly, it is intended that all matter contained in the above description and shown in the accompanying drawings be interpreted in an illustrative and not in a limiting sense. The invention is limited only as defined in the following claims and the equivalents thereto.

What is claimed is:

1. An apparatus for controlling a contrast voltage applied to an LCD device based on a current ambient temperature to cause data to be displayed on the LCD device with a contrast ratio that is associated with the contrast voltage and ambient temperature, wherein said applied contrast voltage is determined in accordance with a standard operating range of ambient temperatures and corresponding contrast voltages when said ambient temperature is below a first ambient temperature, and an extended operating range of ambient temperatures and corresponding contrast voltages when said ambient temperature is greater than a second ambient temperature; and wherein the LCD device inverts the displayed data at ambient temperatures greater than said standard operating temperatures, and wherein said apparatus generates a command to invert data provided to the LCD device.

2. The apparatus of claim 1, wherein said first ambient temperature is greater than said second ambient temperature.

3. The apparatus of claim 1, wherein said first operational temperature is substantially equal to said second ambient temperature.

4. The apparatus of claim 1, wherein said apparatus implemented in a defibrillator.

5. The apparatus of claim 4, wherein said defibrillator further comprises:

a temperature sensor constructed and arranged to sense said current ambient temperature.

6. The apparatus of claim 1, wherein said apparatus adjusts a frame rate based on said current ambient temperature.

7. The apparatus of claim 6, wherein said frame rate is proportional to ambient temperatures.

8. A liquid crystal display (LCD) device temperature compensation control system that controls a contrast voltage provided to an LCD device based on ambient temperature to cause the LCD device to display data with a visible contrast ratio beyond the normal, manufacturer-specified operational temperature range, or to improve the contrast of displayed data at upper regions of the normal temperature range; and an LCD contrast operational mode selector that determines whether a contrast voltage supplied to an LCD device is to be controlled in accordance with a standard operational mode defined by normal ambient temperatures and corresponding standard contrast voltages, or an extended operational mode defined by ambient temperatures equal to or greater than said normal ambient temperatures and corresponding extended contrast voltages; and a contrast voltage selector that generates said contrast voltage based on said selected contrast operational mode so that the data is displayed without an inverted contrast in the extended operational mode.

9. The system of claim 8, further comprising:

an external adjustment interface that generates an offset component for adjusting said contrast voltage in response to a contrast control input signal.

10. The system of claim 8, further comprising:

a frame rate selector that mode generates a frame rate command based on said ambient temperature.

11. The system of claim 10, wherein said frame rate selector generates said frame rate command based also on whether said contrast voltage is to be set in accordance with said standard or said extended operational mode.

12. The system of claim 10, wherein said frame rate selector generates said frame rate command indicating a frame rate of approximately 50 Hz when operating within said standard operational mode, and to approximately 70 Hz when operating within said extended operational mode.

13. The system of claim 8, further comprising:

a data inversion state selector that operational mode selection generates a data inversion state command, based on whether said contrast voltage is to be set in accordance with said standard or said extended operational mode.

14. A liquid crystal display (LCD) device temperature compensation control system that controls contrast control parameters including:

a contrast voltage applied to an LCD device;

a frame rate with which data is provided to the LCD device for display; and an inversion state of the displayed data, wherein said contrast control parameters are adjusted such that the LCD device displays data with a particular contrast and contrast ratio, and wherein the LCD device inverts displayed data at ambient operating temperatures in an extended operating range so that a contrast of the displayed data is non-inverted.

15. A defibrillator comprising:

a liquid crystal display (LCD) device that displays data with a contrast ratio that is dependent upon a received contrast voltage and ambient temperature, the LCD device displaying data with a contrast ratio less than one for a standard contrast voltage/ambient temperature operational range and an extended contrast voltage/ambient temperature operational range, wherein said extended operating range is effective for ambient temperatures that are greater than or equal to temperatures defining said standard operating range; and a device that controls the contrast voltage supplied to the LCD device such that it operates within either the standard or extended operating ranges based on ambient temperature to achieve an optimum contrast ratio;

wherein the LCD device inverts displayed data at ambient operating temperatures in said extended operating range so that a contrast of the displayed data is non-inverted.

16. A method for controlling the contrast voltage supplied to an LCD device comprising the steps of:

monitoring ambient temperature of LCD device; and supplying a contrast voltage to the LCD device, the contrast voltage being associated with a selected one of either a standard operating range of ambient temperatures or an extended operating range of ambient temperatures greater than said standard operating range of ambient temperatures, wherein said contrast voltage is determined based on a current ambient temperature and said selected operational mode, and determining a data inversion state of the data provided to LCD display device, wherein the LCD device inverts displayed data at ambient operating temperatures in said extended operating range so that a contrast of the displayed data is non-inverted.

17. The method of claim 16, further comprising the steps of:

determining a frame rate at which the data is provided to LCD display device.

* * * * *